US011680399B2

(12) United States Patent
Houston et al.

(10) Patent No.: US 11,680,399 B2
(45) Date of Patent: Jun. 20, 2023

(54) SYSTEM AND APPARATUS FOR SECURING A FLOORPLATE TO A STRUCTURE

(71) Applicant: BIG TIME INVESTMENT, LLC, Southfield, MI (US)

(72) Inventors: Stephen T. Houston, Rochester Hills, MI (US); Joseph Michael Benvenuto, Monroe, MI (US); Aleksei Ivanikiw, Clarkston, MI (US); Yaroslav Stakhiv, Milford, MI (US)

(73) Assignee: BIG TIME INVESTMENT, LLC, Southfield, MI (US)

( * ) Notice: Subject to any disclaimer, the term of this patent is extended or adjusted under 35 U.S.C. 154(b) by 158 days.

(21) Appl. No.: 17/232,173

(22) Filed: Apr. 16, 2021

(65) Prior Publication Data

US 2022/0333368 A1 Oct. 20, 2022

(51) Int. Cl.
*E04B 1/24* (2006.01)

(52) U.S. Cl.
CPC .... *E04B 1/2403* (2013.01); *E04B 2001/2415* (2013.01); *E04B 2001/2418* (2013.01)

(58) Field of Classification Search
CPC ..... E04B 1/2403; E04B 2001/2415; E04B 2001/2644; E04B 2001/2418; E04B 2001/2439; E04B 2001/2445; E04B 2001/2448; E04C 2003/0413; E04C 3/29; E04C 3/14; E04C 3/06; E04C 2003/0417; E04C 2003/0452
See application file for complete search history.

(56) References Cited

U.S. PATENT DOCUMENTS

| | | | | |
|---|---|---|---|---|
| 2,382,584 | A * | 8/1945 | Scheyer | F16B 31/021 403/2 |
| 4,047,341 | A * | 9/1977 | Bernardi | E04B 1/2403 52/223.1 |
| 6,754,992 | B1 * | 6/2004 | Byfield | E04B 1/2403 52/36.5 |
| 7,148,443 | B2 * | 12/2006 | Bong | B23K 37/0235 219/73.1 |
| 7,497,054 | B2 * | 3/2009 | Takeuchi | E04C 3/04 403/403 |
| 8,898,907 | B1 * | 12/2014 | Bong | E04B 1/2403 29/897.3 |
| 10,316,507 | B2 * | 6/2019 | Richards | E04H 9/024 |
| 10,584,477 | B2 * | 3/2020 | Richards | E04B 1/98 |
| 10,900,215 | B1 | 1/2021 | Alrubaidi et al. | |
| 2002/0100229 | A1 * | 8/2002 | Chen | E04C 3/30 52/167.1 |

(Continued)

FOREIGN PATENT DOCUMENTS

| | | | |
|---|---|---|---|
| CN | 110318464 | A | 10/2019 |
| CN | 110593431 | A | 12/2019 |
| FR | 2362251 | A1 | 3/1978 |

*Primary Examiner* — Brian E Glessner
*Assistant Examiner* — Adam G Barlow
(74) *Attorney, Agent, or Firm* — Quinn IP Law

(57) ABSTRACT

A multi-story building that includes a vertical support core and a plurality of floor plates is described, wherein fabrication of the building includes, in one embodiment, assembling each of the floor plates at or near ground level, and lifting each of the floor plates to a design level on the vertical support core. A system and device for securing one of the floor plates to the building includes employing a vertically-oriented lock-in bracket.

20 Claims, 4 Drawing Sheets

(56) References Cited

U.S. PATENT DOCUMENTS

| | | | | |
|---|---|---|---|---|
| 2002/0184836 | A1* | 12/2002 | Takeuchi | E04B 1/2403 52/289 |
| 2007/0163204 | A1* | 7/2007 | Ceba | E04B 1/2403 52/741.1 |
| 2012/0066990 | A1* | 3/2012 | Cajot | E04B 1/945 52/232 |
| 2013/0001383 | A1* | 1/2013 | Jay | E04B 1/2403 248/214 |
| 2014/0182234 | A1* | 7/2014 | Yang | E04B 1/2403 52/655.1 |
| 2017/0218616 | A1* | 8/2017 | Richards | E04H 9/024 |
| 2018/0274223 | A1* | 9/2018 | Richards | E04C 3/06 |
| 2021/0140167 | A1* | 5/2021 | Adams | E04B 1/2403 |
| 2022/0333368 | A1* | 10/2022 | Houston | E04B 1/2403 |

* cited by examiner

SYSTEM AND APPARATUS FOR SECURING A FLOORPLATE TO A STRUCTURE

TECHNICAL FIELD

The disclosure generally relates to an apparatus and system for securing a floor plate to a structure.

BACKGROUND

Various methods can be employed to fabricate and construct multi-story buildings. Traditionally, multi-story buildings have been constructed from the ground up, in which construction of the building begins on a ground level by attaching higher elevation structural elements on top of previously assembled lower structural elements to construct the building in upward direction, i.e., from bottom up. Such methods may be inefficient in terms of material handling and placement. Presently, structural framing elements may be assembled into a building frame one member at a time and above ground level. Tower cranes are used during construction to execute thousands of individual lifts for elements of the structure, building enclosure, finishes, mechanical and electrical equipment and many other components of a finished building. Furthermore, concrete or another hardenable material is pumped to the final elevation of each floor. These operations may require specialized equipment and setup logistics, and may be time-consuming and labor-intensive when constructing multi-story buildings.

One method of fabricating a building includes fabricating a vertical support core, and sequentially assembling a plurality of floor plates at an assembly level. Each of the floor plates is then lifted to a design level.

There is a need to provide a system and a device for securing a floor plate to a vertical support core at the design level.

SUMMARY

A multi-story building that includes a vertical support core and a plurality of floor plates is described, wherein fabrication of the building includes, in one embodiment, assembling each of the floor plates at or near ground level, and lifting each of the floor plates to a design level on the vertical support core.

This includes a system for securing a floor plate to a structure that has a vertical support core having at least one vertically-oriented column including a first beam. The first beam has a first flange, a web portion, and a second flange. A first plurality of through bolt holes are formed in the first flange of the first beam, and the first flange of the first beam has an outer surface. A floor plate includes at least one horizontal girder with a second beam that has an upper flange, a lower flange, and a web portion. A first vertical stiffener is affixed to the upper flange, the lower flange, and the web portion on a first side of the second beam. A second vertical stiffener is affixed to the upper flange, the lower flange, and the web portion on a second side opposed to the first side of the second beam. A vertically-oriented lock-in bracket includes a third beam having a flange portion and a web portion, and a bracket horizontal stiffener. The web portion of the third beam is affixed to the first vertical stiffener of the second beam at a lower portion of the third beam, and a second plurality of through bolt holes are formed on the flange portion of the third beam at an upper portion thereof. A plurality of bolts are also included. When the floor plate is disposed at a design level on the vertical support core, the first plurality of through bolt holes in the first flange of the first beam are disposed opposite to and correspond to the second plurality of through bolt holes disposed on the upper portion of the flange portion of the third beam. When the floor plate is disposed at the design level on the vertical support core, the plurality of bolts are inserted through the first plurality of through bolt holes and the second plurality of through bolt holes and secured thereto.

An aspect of the disclosure includes the vertically-oriented lock-in bracket being affixed to the second beam of the floor plate and slidably arranged on the first beam of the vertical support core when the floor plate is disposed at an assembly level. The vertically-oriented lock-in bracket is slidably arranged on the first beam of the vertical support core when the floor plate is disposed at the assembly level.

Another aspect of the disclosure includes the bracket horizontal stiffener being arranged orthogonal to the flange portion and the web portion of the third beam at the lower portion of the third beam.

Another aspect of the disclosure includes, when the floor plate is disposed at the design level on the vertical support core, the web portion of the first beam, the web portion of the second beam, the first vertical stiffener, and the second vertical stiffener being coplanar.

Another aspect of the disclosure includes a plurality of first horizontal stiffeners being affixed to the web portion and the first and second flanges of the first beam.

Another aspect of the disclosure includes, when the floor plate is disposed at the design level on the vertical support core, the lower flange of the second beam, the bracket horizontal stiffener, and one of the first horizontal stiffeners are affixed to the first beam being coplanar.

Another aspect of the disclosure includes, when the floor plate is disposed at the design level on the vertical support core, others of the first horizontal stiffeners of the first beam are affixed to the first beam adjacent to the upper portion of the flange portion of the second beam.

Another aspect of the disclosure includes the floor plate being assembled at a first level on the vertical support core and lifted to the design level on the vertical support core.

Another aspect of the disclosure includes the floor plate being slidably disposed on the vertical support core prior to being lifted and secured to the vertical support core at the design level.

Another aspect of the disclosure includes the outer surface of the first flange of the first beam having a slip-critical surface, an outer surface of the flange portion of the third beam having a slip-critical surface, and the slip-critical surface of the outer surface of the flange portion of the first beam being arranged opposite to the slip-critical surface of the outer surface of the flange portion of the third beam to form a slip-critical interface when the floor plate is arranged at the design level on the vertical support core.

Another aspect of the disclosure includes the first beam of the vertical support core being a steel I-beam having a web portion that is arranged between the first flange and a second flange.

Another aspect of the disclosure includes the second beam being a steel I-beam having the web portion arranged between the first flange and the second flange.

Another aspect of the disclosure includes the third beam being a steel T-beam.

Another aspect of the disclosure includes a device for securing, to a vertically-oriented first beam of a vertical support core, a horizontally-oriented second beam of a floor plate. The device includes a vertically-oriented lock-in bracket including a third beam having a flange portion and a web portion, and a bracket horizontal stiffener. A plurality of bolt holes are formed on the flange portion of the third beam at an upper portion thereof. The bracket horizontal stiffener is arranged orthogonal to the flange portion and the web portion of the third beam at a lower portion thereof. An outer surface of the flange portion of the third beam has a slip-critical surface. The vertically-oriented lock-in bracket is affixed to the horizontally-oriented second beam of the floor plate and is slidably arranged on the vertically-oriented first beam of the vertical support core when the floor plate is disposed at an assembly level. The vertically-oriented lock-in bracket is slidably arranged on the vertically-oriented first beam of the vertical support core when the floor plate is disposed at the assembly level. The vertically-oriented lock-in bracket is affixed to the vertically-oriented first beam of the vertical support core when the floor plate is disposed at a design level.

Another aspect of the disclosure includes the vertically-oriented lock-in bracket being affixed to the horizontally-oriented second beam of the floor plate by having the web portion of the third beam being affixed to a first vertical stiffener of the horizontally-oriented second beam at the lower portion of the third beam, and the first vertical stiffener being affixed to an upper flange, a lower flange, and a web portion of the horizontally-oriented second beam on a first side.

Another aspect of the disclosure includes the slip-critical surface of the outer surface of the flange portion of the third beam being arranged opposite to a slip-critical surface of an outer surface of a flange portion of the first beam to form a slip-critical interface when the floor plate is disposed at the design level on the vertical support core.

Another aspect of the disclosure includes the floor plate being disposed at the design level on the vertical support core, with the plurality of bolt holes formed on the flange portion of the third beam being disposed opposite to and corresponding to a plurality of through bolt holes arranged in a flange portion of the first beam.

Another aspect of the disclosure includes the slip-critical surface of the outer surface of the flange portion of the third beam being arranged opposite to a slip-critical surface of an outer surface of a flange portion of the horizontally-oriented first beam to form a slip-critical interface when the floor plate is arranged at the design level on the vertical support core.

Another aspect of the disclosure includes the third beam being a steel T-beam.

Another aspect of the disclosure includes a system for securing a floor plate to a structure in the form of a vertical support core having at least one vertically-oriented column including a first beam, wherein the first beam has a first flange, a web portion, and a second flange, and the first flange of the first beam having an outer surface, and wherein the outer surface of the first flange of the first beam has a slip-critical surface. A floor plate includes at least one horizontal girder including a second beam, the second beam having an upper flange, a lower flange, and a web portion. A vertically-oriented lock-in bracket includes a third beam having a flange portion and a web portion, wherein the third beam is affixed to the second beam at a lower portion of the third beam, and wherein an outer surface of the flange portion of the third beam has a slip-critical surface. The slip-critical surface of the outer surface of the flange portion of the first beam is arranged opposite to the slip-critical surface of the outer surface of the flange portion of the third beam to form a slip-critical interface when the floor plate is arranged at the design level on the vertical support core.

The above summary is not intended to represent every possible embodiment or every aspect of the present disclosure. Rather, the foregoing summary is intended to exemplify some of the novel aspects and features disclosed herein. The above features and advantages, and other features and advantages of the present disclosure, will be readily apparent from the following detailed description of representative embodiments and modes for carrying out the present disclosure when taken in connection with the accompanying drawings and the claims.

It should be understood that the appended drawings are not necessarily to scale, and present a somewhat simplified representation of various preferred features of the present disclosure as disclosed herein, including, for example, specific dimensions, orientations, locations, and shapes. Details associated with such features will be determined in part by the particular intended application and use environment.

DETAILED DESCRIPTION

The components of the disclosed embodiments, as described and illustrated herein, may be arranged and designed in a variety of different configurations. Thus, the following detailed description is not intended to limit the scope of the disclosure, as claimed, but is merely representative of possible embodiments thereof. In addition, while numerous specific details are set forth in the following description in order to provide a thorough understanding of the embodiments disclosed herein, some embodiments can be practiced without some of these details. Moreover, for the purpose of clarity, certain technical material that is understood in the related art has not been described in detail in order to avoid unnecessarily obscuring the disclosure. Furthermore, the drawings are in simplified form and are not to precise scale. For purposes of convenience and clarity, directional terms such as top, bottom, left, right, up, over, above, below, beneath, rear, and front, may be used with respect to the drawings. These and similar directional terms are descriptive of the figures, and not to be construed to limit the scope of the disclosure. Furthermore, the disclosure, as illustrated and described herein, may be practiced in the absence of an element that is not specifically disclosed herein.

Figure 1:
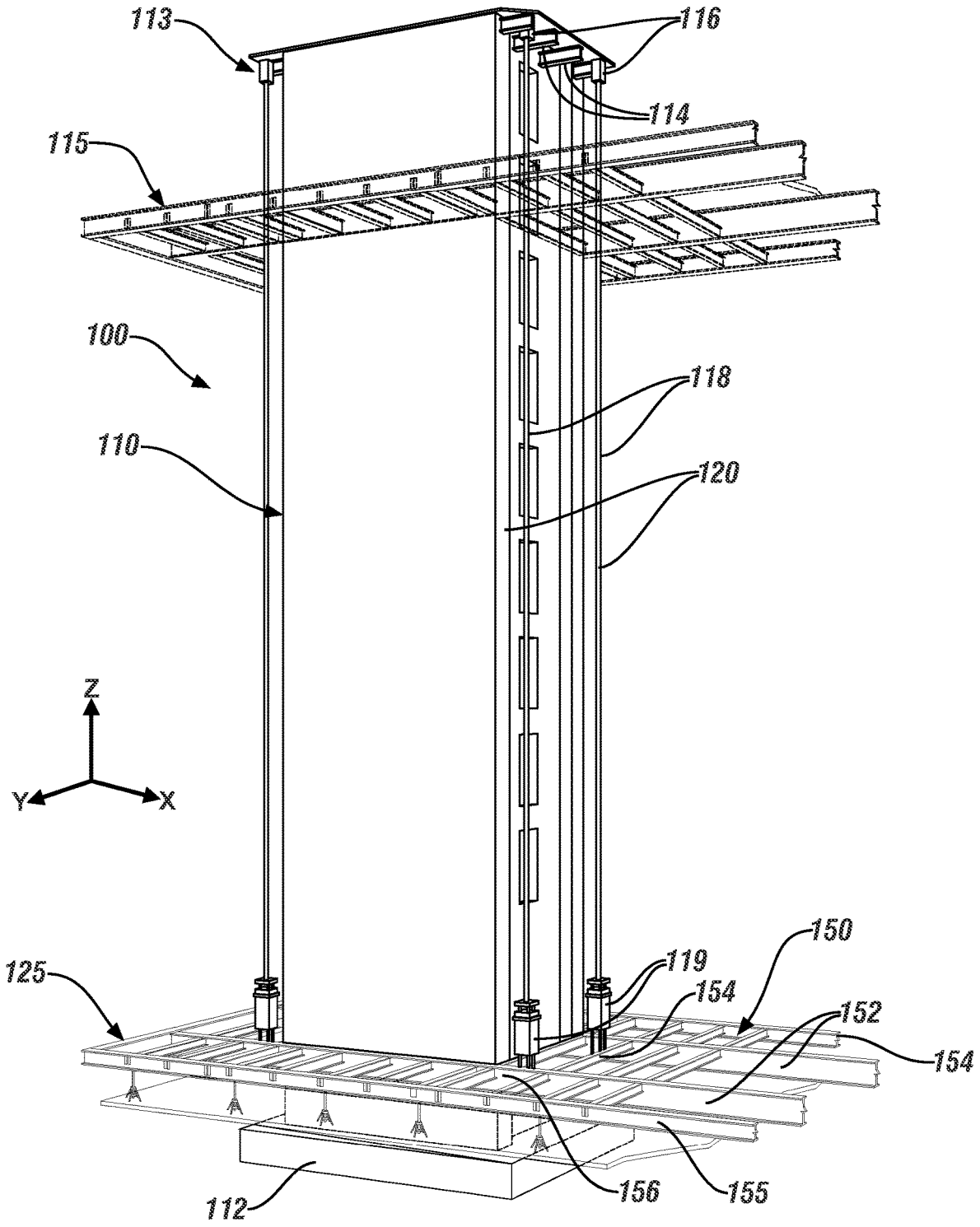
FIG. 1 is a side perspective isometric view of a partially constructed building, in accordance with the disclosure.

Referring to the Figures, wherein like numerals indicate like parts throughout the several views, FIG. 1 shows a vertical support core 110 for a building 100 that is arranged on a base 112, wherein the building 100 is fabricated employing a top-down construction process. In general, the top-down construction process includes sequentially constructing a plurality of floor plates 150 at an assembly level 125, lifting each of the floor plates 150 to a respective design elevation 115, and securing each of the floor plates 150 to the vertical support core 110 of the building 100 in a descending order. Each of the floor plates 150 is secured to the vertical support core 110 of the building 100 employing a plurality of lock-in brackets 30, one of which is described with reference to FIGS. 2, 3, and 4. The building 100 includes a single vertical support core 10 as shown with reference to FIG. 1. Multiple vertical support cores may be employed in some embodiments. The concepts set forth herein are described with reference to an xyz-coordinate system, wherein x represents a lateral axis, y represents a longitudinal axis, and z represents a vertical axis. A horizontal plane is defined by the x and y axes.

As used herein, the term "floor plate" includes but is not limited to all structural or frame members, e.g., joists and/or purlins; flooring, e.g., concrete floor; interior walls; exterior curtain walls; modular room subassemblies; lavatories; mechanical building elements, etc., that form a floor or level of the building 100. The term "floor plate" may include a plate for a roof structure (not shown) of the building 100, as well as a plate for a floor or level of the building 100. Accordingly, the term "floor plate" is used herein to refer to both the roof structure for the roof of the building 100, as well as a floor structure for one of the floors or levels of the building 100. The reference numeral 150 may refer to and indicate any floor plate of the building 100.

Referring again to FIG. 1, the construction system includes the vertical support core 110, which is an element of a vertical slip form system. The vertical support core 110 is formed from a plurality of vertical load-bearing columns 120, cross-members, and outer shear walls that are formed from a hardenable material. In one embodiment, the vertical support core 110 has a rectangular cross-section with one of the vertical load-bearing columns 120 arranged at each of the corners thereof. Each of the vertical load-bearing columns 120 includes a first beam 20, which is illustrated and described with reference to FIGS. 2 and 3. There may be 2, 4, 6, 8, or another quantity of vertical load-bearing columns 120 in the vertical support core 110. Each of the first beams 20 may be a steel I-beam in one embodiment, or, alternatively, a steel box beam or another beam arrangement.

The vertical support core 110 also includes a plurality of horizontal roof beams 114 that are arranged on a top portion 113 thereof. The vertical support core 110 is designed to carry the vertical loads of the building 100. As such, the shape of the vertical support core 110 may be designed as necessary to provide the required compressive strength, shear strength, and bending strength for the particular application, size, and location of the building 100.

The hardenable material may include, but is not limited to, a concrete mixture or other similar composition. The hardenable material may include one or more additives to enhance one or more physical characteristics of the hardenable material, such as to reduce curing time, reduce slump, increase strength, etc. The specific type and contents of the hardenable material may be dependent upon the specific application of the building 100, and may be dependent upon the specific geographic region in which the building 100 is being constructed. The specific type and contents of the hardenable material are understood by those skilled in the art, and are not described in detail herein.

A plurality of lift jacks 116 are attached to the roof beams 114 of the vertical support core 110, and are employed to lift the floor plates 150 to their respective design elevations 115. The lift jacks 116 may include, but are not limited to a plurality of strand jacks. Alternatively, the lift jacks 116 may include other devices capable of lifting each of the floor plates 150 of the building 100. Strand jacks are able to grasp and move a cable to lift heavy objects. The specific features and operation of lift jacks 116 such as strand jacks are known to those skilled in the art. The lift jacks 116 couple to a bridle (not shown) that is disposed underneath each of the floor plates 150 via cables 118 and lockable joints 119.

As shown, each of plurality of the floor plates 150 can be assembled on the bridle, which is placed at an assembly level 125 that is at or proximal to ground elevation. The plurality of the floor plates 150 are lifted to their respective design elevations 115 relative to the vertical support core 110 in a sequential descending order employing the lift jacks 116. Element 151 indicates one of the floor plates 150 that has been lifted to its respective design elevation 115 for attachment to the vertical support core 110 employing an embodiment of a lock-in bracket 30, which is described with reference to FIGS. 2, 3 and 4.

Referring again to FIG. 1, each of the floor plates 150 includes one or multiple girders 152 that are secured to the plurality of columns 120 of the vertical support core 110 of the building 100 employing the lock-in brackets 30. Other elements of the floor plate 150 include a floor plate frame that includes framing members 154, 156, and spandrels 155. Metal decking (not shown) is attached to the floor plate frame, and hardenable material is dispersed onto the metal decking. Mechanical building elements are assembled onto the floor plate frame beneath the metal decking when the floor plate 150 is disposed at the assembly level 125.

Figure 2:
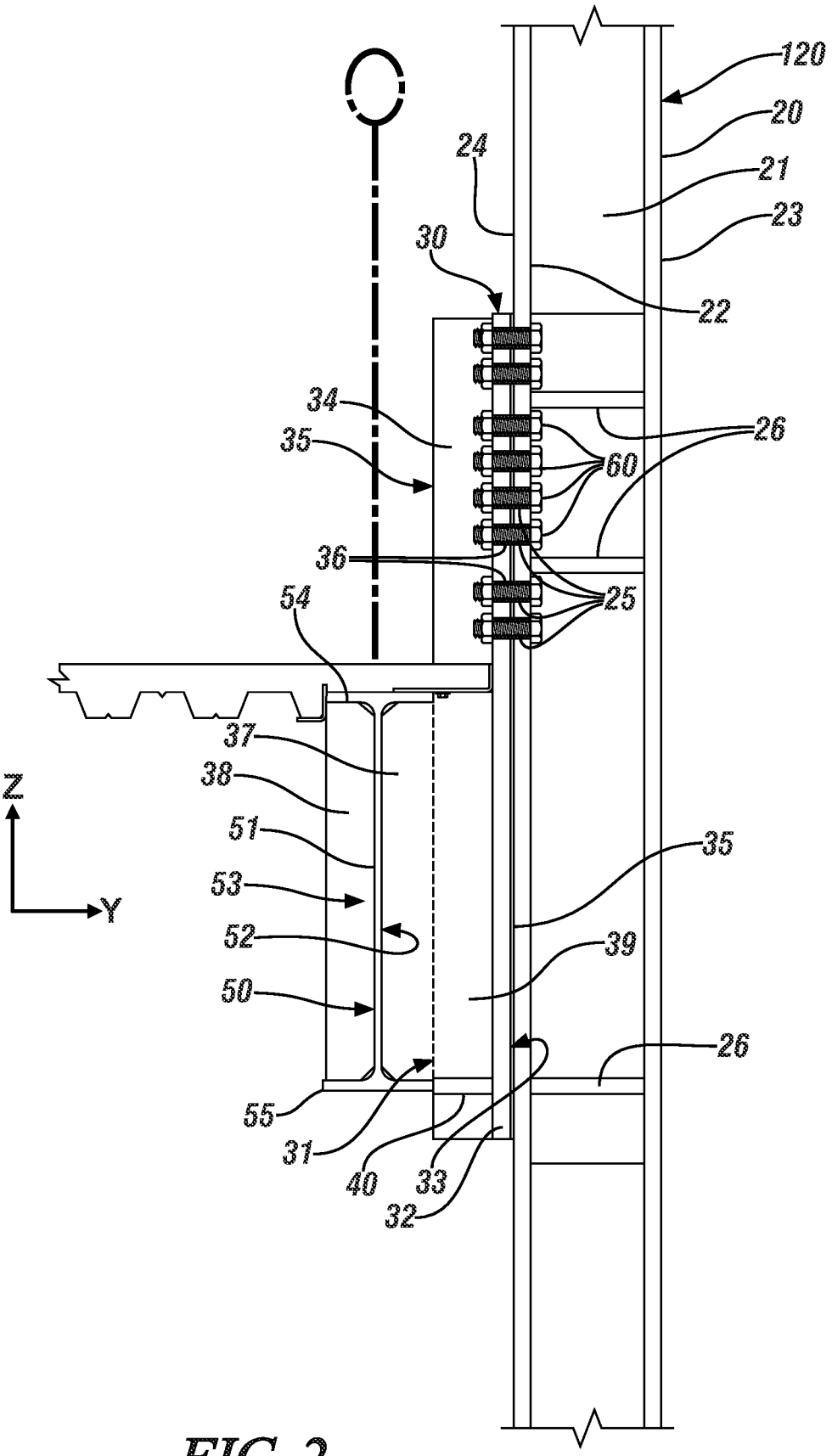
FIG. 2 is a side view of an embodiment of a system and device for securing a floor plate to a structure employing a vertically-oriented lock-in bracket, in accordance with the disclosure.
Figure 3:
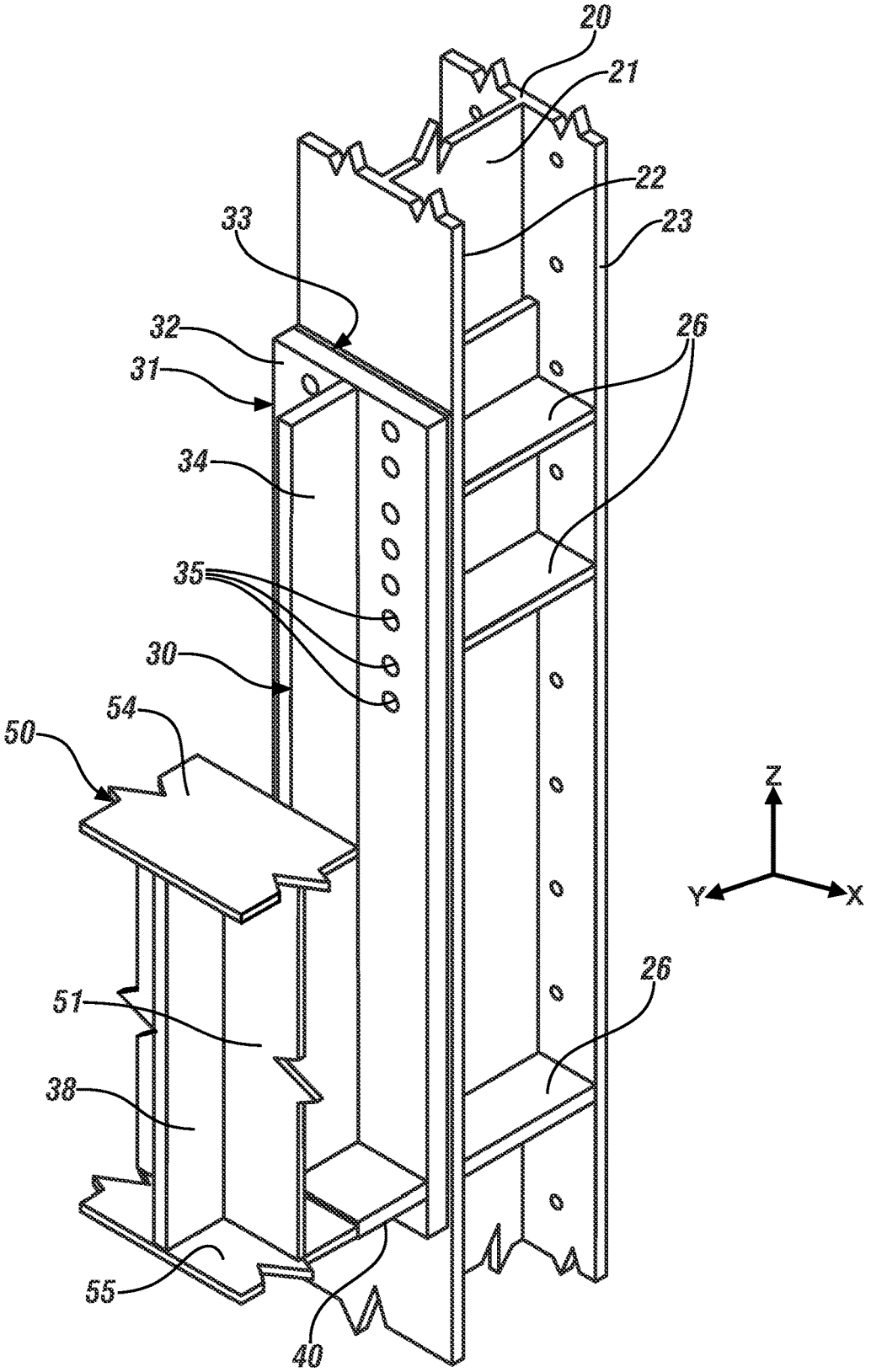
FIG. 3 is top-side perspective isometric view of an embodiment of a system and device for securing a floor plate to a structure employing a vertically-oriented lock-in bracket, in accordance with the disclosure.

FIGS. 2 and 3 schematically illustrate details related to an embodiment of the lock-in bracket 30 for securing one of the floor plates 150 to the vertical support core 110 of the building 100. Each of the first beams 20 of the columns 120 is a steel I-beam in one embodiment, with a first, outwardly facing flange 22 having an outer surface 24, a second flange 23, and a web portion 21. A first plurality of through bolt holes 25 are formed in the first flange 22 of the first beam 20, and are designed to accommodate torque-critical attachment fasteners 60, e.g., bolts. Each of the horizontal girders 152 is formed with a second beam 50, which is a steel I-beam in one embodiment, having an upper flange 54, a lower flange 55, and a web portion 51. A first side 52 of the second beam 50 is disposed to face the vertical support core 110 and the lock-in bracket 30, and a second side 53 that is opposed to the first side 52.

A first vertical stiffener 37 is affixed to the upper flange 54, the lower flange 55, and the web portion 51 of the second beam 50 on the first side 52 of the second beam 50. In one embodiment, the first vertical stiffener 37 is fabricated from 0.50 inch thick steel plate, and is affixed by seam welding to the upper flange 54, the lower flange 55, and the web portion 51 of the second beam 50 on the first side 52.

A second vertical stiffener 38 affixed to the upper flange 54, the lower flange 55, and the web portion 51 of the second beam 50 on the second side 53 of the second beam 50. In one embodiment, the second vertical stiffener 38 is fabricated from 0.50 inch thick steel plate, and is affixed by seam welding to the upper flange 54, the lower flange 55, and the web portion 51 of the second beam 50 on the second side 53.

The vertically-oriented lock-in bracket 30 is affixed to the second beam 50 at a location that is adjacent to one of the first beams 20 of the columns 120.

The vertically-oriented lock-in bracket 30 includes a third beam 31 having a flange portion 32 and a web portion 34, and a bracket horizontal stiffener 40. The web portion 34 of the third beam 31 is affixed to the first vertical stiffener 37 of the second beam 50 at a lower portion 39 of the third beam 31, by seam welding, tack welding, or another joining process. A second plurality of through bolt holes 36 are formed on the flange portion 32 of the third beam 31 at an upper portion 35 thereof.

When the floor plate 150 is disposed at a design level 115 on the vertical support core 110 (as shown with reference to FIG. 1) the first plurality of through bolt holes 25 in the first flange 22 of the first beam 20 are disposed opposite to and correspond to the second plurality of through bolt holes 36 that are disposed on the upper portion 35 of the flange portion 32 of the third beam 31. In one embodiment, the first plurality of through bolt holes 25 in the first flange 22 of the first beam 20 are configured as oversized bolt holes that are elongated in the z-direction, i.e., in parallel with the vertical axis to enable vertical adjustment of the floor plate 150 when disposed at the design level 115 on the vertical support core 110. When the floor plate 150 is disposed at the design level 115 on the vertical support core 110, the plurality of torque-critical attachment fasteners 60 are inserted through the first plurality of through bolt holes 25 and the second plurality of through bolt holes 36 and secured thereto using nuts, lock washers, and/or other bolt fasteners.

The vertically-oriented lock-in bracket 30 is affixed to the second beam 50 of the floor plate 150 and is slidably arranged on the first beam 20 of the vertical support core 110 when the floor plate 150 is disposed at the assembly level 125.

A bracket horizontal stiffener 40 is affixed to the lower portion 39 of the third beam with a planar orientation in the horizontal plane, i.e., the bracket horizontal stiffener 40 is orthogonal to the flange portion 32 and the web portion 34 of the third beam 31.

When the floor plate 150 is disposed at the design level 115 on the vertical support core 110, the web portion 21 of the first beam 20, the web portion 34 of the third beam 31, the first vertical stiffener 37, and the second vertical stiffener 38 are coplanar, and thus form a continuous vertically-oriented sheet of steel.

A plurality of first horizontal stiffeners 26 are affixed to the web portion 21 and the first and second flanges 22, 23 of the first beam 20 by seam welding or by another method. When the floor plate 150 is disposed at the design level 115 on the vertical support core 110, the lower flange 55 of the second beam 50, the bracket horizontal stiffener 40, and one of the first horizontal stiffeners 26 that are affixed to the first beam 20 are coplanar and thus form a continuous horizontally-oriented sheet of steel. When the floor plate 150 is disposed at the design level 115 on the vertical support core 110, others of the first horizontal stiffeners 26 of the first beam 20 are affixed to the first beam 20 adjacent to the upper portion 35 of the flange portion 32 of the third beam 31.

The outer surface 24 of the first flange 22 of the first beam 20 has a slip-critical surface, and an outer surface 33 of the flange portion 32 of the third beam 31 has a slip-critical surface. When the floor plate 150 is disposed at the design level 115 on the vertical support core 110, the slip-critical surface of the outer surface 24 of the first flange 22 of the first beam 20 is arranged opposite to the slip-critical surface of the outer surface 33 of the flange portion 32 of the third beam 31 to form a slip-critical interface. A slip-critical interface is a joint that relies upon friction between the two elements to effect the joining, and have a low likelihood of slip during the life of the structure, without reliance upon a fastener such as a bolt.

Figure 4:
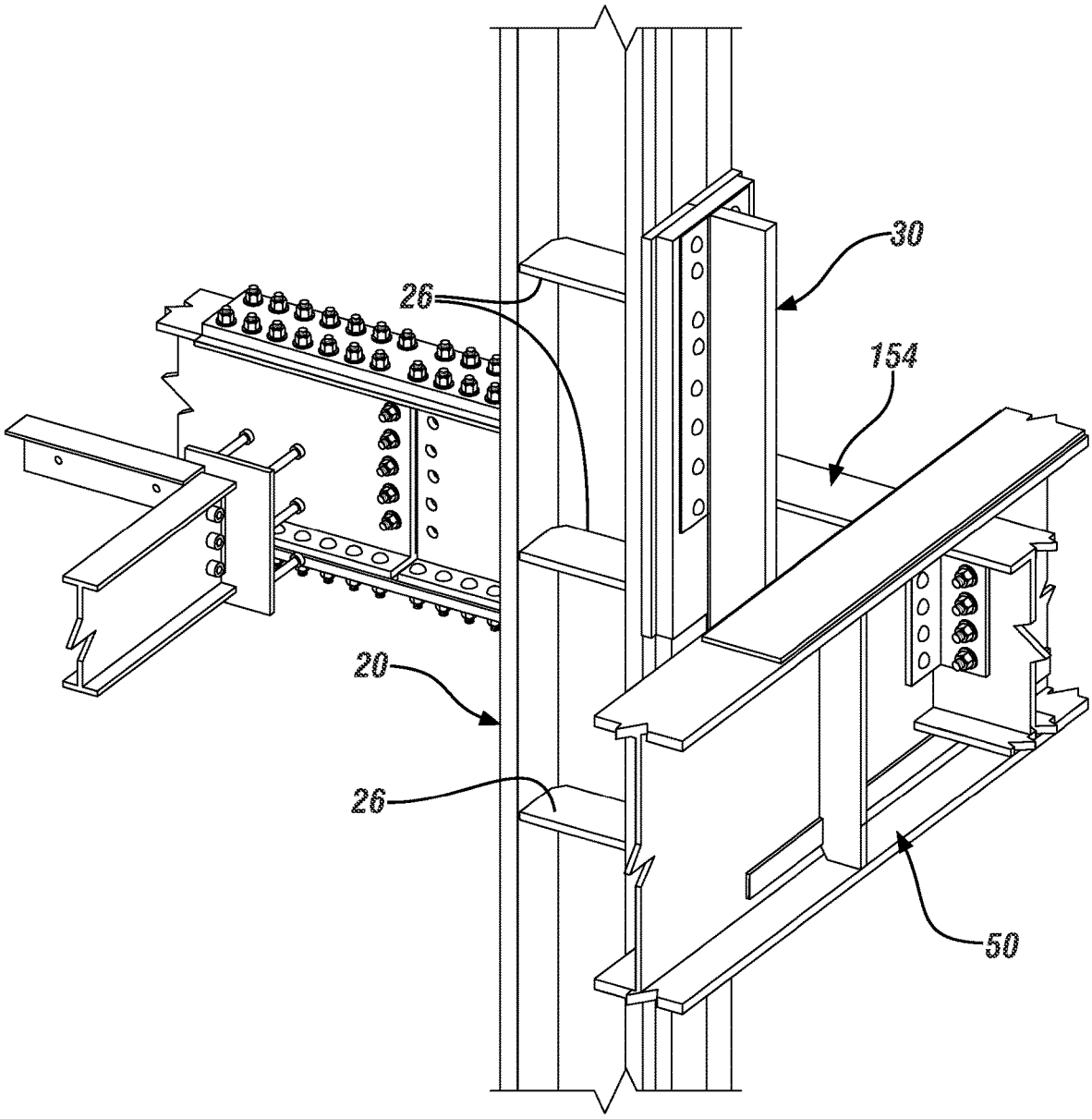
FIG. 4 is side perspective isometric view of an embodiment of a system and device for securing a floor plate to a structure employing a vertically-oriented lock-in bracket, in accordance with the disclosure.

FIG. 4 schematically illustrates an isometric view of a portion of the system and device for securing one of the floor plates 150 to one of the columns 120 of the vertical support core 110 employing the vertically-oriented lock-in bracket 30. One of the first beams 20 of the column 120 is attached via the lock-in bracket 30 to one of the second beams 50, which is one of the girders 152 of the floor plate 150. Also shown is one of the framing members 154, which passes through an opening in the second beam 50. As appreciated, this arrangement is repeated on each of the corners of the vertical support core 110, thus facilitating securement of the floor plate 150 to the vertical support core 110.

The detailed description and the drawings or figures are supportive and descriptive of the disclosure, but the scope of the disclosure is defined solely by the claims. While some of the best modes and other embodiments for carrying out the claimed teachings have been described in detail, various alternative designs and embodiments exist for practicing the disclosure defined in the appended claims.

The invention claimed is:

1. A system for securing a floor plate to a structure, comprising:

a vertical support core having at least one vertically-oriented column including a first beam;

wherein the first beam has a first flange, a web portion, and a second flange, a first plurality of through bolt holes being formed in the first flange of the first beam, and the first flange of the first beam having an outer surface;

a floor plate including at least one horizontal girder including a second beam, the second beam having an upper flange, a lower flange, and a web portion;

a first vertical stiffener affixed to the upper flange, the lower flange, and the web portion on a first side of the second beam;

a second vertical stiffener affixed to the upper flange, the lower flange, and the web portion on a second side opposed to the first side of the second beam;

a vertically-oriented lock-in bracket including a third beam having a flange portion and a web portion, and a bracket horizontal stiffener;

wherein the web portion of the third beam is affixed to the first vertical stiffener of the second beam at a lower portion of the third beam, and wherein a second plurality of through bolt holes are formed on the flange portion of the third beam at an upper portion thereof; and a plurality of bolts;

wherein, when the floor plate is disposed at a design level on the vertical support core, the first plurality of through bolt holes in the first flange of the first beam are disposed opposite to and correspond to the second plurality of through bolt holes disposed on the upper portion of the flange portion of the third beam; and wherein, when the floor plate is disposed at the design level on the vertical support core, the plurality of bolts are inserted through the first plurality of through bolt holes and the second plurality of through bolt holes and secured thereto.

2. The system of claim 1, wherein the vertically-oriented lock-in bracket is affixed to the second beam of the floor plate and is slidably arranged on the first beam of the vertical support core when the floor plate is disposed at an assembly level; and wherein the vertically-oriented lock-in bracket is slidably arranged on the first beam of the vertical support core when the floor plate is disposed at the assembly level.

3. The system of claim 1, wherein the bracket horizontal stiffener is arranged orthogonal to the flange portion and the web portion of the third beam at the lower portion of the third beam.

4. The system of claim 1, wherein, when the floor plate is disposed at the design level on the vertical support core, the web portion of the first beam, the web portion of the third beam, the first vertical stiffener, and the second vertical stiffener are coplanar.

5. The system of claim 1, further comprising a plurality of first horizontal stiffeners being affixed to the web portion and the first and second flanges of the first beam.

6. The system of claim 5, wherein, when the floor plate is disposed at the design level on the vertical support core, the lower flange of the second beam, the bracket horizontal stiffener, and one of the first horizontal stiffeners affixed to the first beam are coplanar.

7. The system of claim 5, wherein, when the floor plate is disposed at the design level on the vertical support core, others of the first horizontal stiffeners of the first beam are affixed to the first beam adjacent to the upper portion of the flange portion of the second beam.

8. The system of claim 1, comprising the floor plate being slidably disposed on the vertical support core.

9. The system of claim 1, wherein the outer surface of the first flange of the first beam has a slip-critical surface, wherein an outer surface of the flange portion of the third beam has a slip-critical surface, and wherein the slip-critical surface of the outer surface of the flange portion of the first beam is arranged opposite to the slip-critical surface of the outer surface of the flange portion of the third beam to form a slip-critical interface when the floor plate is arranged at the design level on the vertical support core.

10. The system of claim 1, wherein the first beam of the vertical support core comprises a steel I-beam having a web portion that is arranged between the first flange and a second flange.

11. The system of claim 1, wherein the second beam comprises a steel I-beam having the web portion arranged between the first flange and the second flange.

12. The system of claim 1, wherein the third beam comprises a steel T-beam.

13. A device for securing, to a vertically-oriented first beam of a vertical support core, a horizontally-oriented second beam of a floor plate, the device comprising:

a vertically-oriented lock-in bracket including a third beam having a flange portion and a web portion, and a bracket horizontal stiffener;

wherein a plurality of bolt holes are formed on the flange portion of the third beam at an upper portion thereof;

wherein the bracket horizontal stiffener is arranged orthogonal to the flange portion and the web portion of the third beam at a lower portion thereof;

wherein an outer surface of the flange portion of the third beam has a slip-critical surface;

wherein the vertically-oriented lock-in bracket is affixed to the horizontally-oriented second beam of the floor plate and is slidably arranged on the vertically-oriented first beam of the vertical support core when the floor plate is disposed at an assembly level, including the web portion of the third beam being affixed to a first vertical stiffener of the horizontally-oriented second beam at the lower portion of the third beam, and the first vertical stiffener being affixed to an upper flange, a lower flange, and a web portion of the horizontally-oriented second beam on a first side; and wherein the vertically-oriented lock-in bracket is slidably arranged on the vertically-oriented first beam of the vertical support core when the floor plate is disposed at the assembly level, and wherein the vertically-oriented lock-in bracket is affixed to the vertically-oriented first beam of the vertical support core when the floor plate is disposed at a design level.

14. The device of claim 13, wherein the slip-critical surface of the outer surface of the flange portion of the third beam is arranged opposite to a slip-critical surface of an outer surface of a flange portion of the first beam to form a slip-critical interface when the floor plate is disposed at the design level on the vertical support core.

15. The device of claim 13, wherein, when the floor plate is disposed at the design level on the vertical support core, the plurality of bolt holes formed on the flange portion of the third beam are disposed opposite to and correspond to a plurality of through bolt holes arranged in a flange portion of the first beam.

16. The device of claim 13, wherein the slip-critical surface of the outer surface of the flange portion of the third beam is arranged opposite to a slip-critical surface of an outer surface of a flange portion of the first beam to form a slip-critical interface when the floor plate is arranged at the design level on the vertical support core.

17. The device of claim 13, wherein the third beam comprises a steel T-beam.

18. A system for securing a floor plate to a structure/building, comprising:

a vertical support core having at least one vertically-oriented column including a first beam, wherein the first beam has a first flange, a web portion, and a second flange, and the first flange of the first beam having an outer surface, and wherein the outer surface of the first flange of the first beam has a slip-critical surface;

a floor plate including at least one horizontal girder including a second beam, the second beam having an upper flange, a lower flange, and a web portion;

a vertically-oriented lock-in bracket including a third beam having a flange portion and a web portion, wherein the third beam is affixed to the second beam at a lower portion of the third beam, and wherein an outer surface of the flange portion of the third beam has a slip-critical surface;

wherein the vertically-oriented lock-in bracket is affixed to the horizontally-oriented second beam of the floor plate, including the web portion of the third beam being affixed to a first vertical stiffener of the horizontally-oriented second beam at the lower portion of the third beam, and the first vertical stiffener being affixed to the upper flange, the lower flange, and the web portion of the horizontally-oriented second beam on a first side; and wherein the slip-critical surface of the outer surface of the flange portion of the first beam is arranged opposite to the slip-critical surface of the outer surface of the flange portion of the third beam to form a slip-critical interface when the floor plate is arranged at a design level on the vertical support core.

19. The system of claim 13, wherein the web portion of the first beam, the web portion of the third beam, the first vertical stiffener, and the second vertical stiffener are coplanar.

20. The system of claim 13, wherein the web portion of the first beam, the web portion of the third beam, the first vertical stiffener, and the second vertical stiffener form a continuous vertically-oriented sheet of steel.

* * * * *